US006955261B2

(12) United States Patent
Ploix et al.

(10) Patent No.: US 6,955,261 B2
(45) Date of Patent: Oct. 18, 2005

(54) HAIR SWATCH DISPLAY DEVICE, AND DISPLAY SYSTEM EQUIPPED WITH AT LEAST ONE SUCH DEVICE

(75) Inventors: Dominique Ploix, Paris (FR); Nathalie Eskenazi, Saint-Ouen (FR)

(73) Assignee: L'Oreal, Paris (FR)

( * ) Notice: Subject to any disclaimer, the term of this patent is extended or adjusted under 35 U.S.C. 154(b) by 368 days.

(21) Appl. No.: 10/263,951

(22) Filed: Oct. 4, 2002

(65) Prior Publication Data

US 2003/0080026 A1 May 1, 2003

(30) Foreign Application Priority Data

Oct. 12, 2001 (FR) ..... 01 13190

(51) Int. Cl.[7] ..... B65D 85/00

(52) U.S. Cl. ..... 206/388; 206/775; 434/94; 434/99

(58) Field of Search ..... 206/733; 17/734, 17/735, 388, 775, 779, 581, 823; 434/94, 98, 99

(56) References Cited

U.S. PATENT DOCUMENTS

| | | | | |
|---|---|---|---|---|
| 250,430 A | * | 12/1881 | Bertsche et al. | 206/388 |
| 650,630 A | | 5/1900 | Chamberlain | |
| 5,609,484 A | * | 3/1997 | Hawiuk | 434/94 |
| 5,647,485 A | | 7/1997 | Verrangia | |
| 5,794,776 A | * | 8/1998 | Corella | 206/388 |
| 6,102,209 A | * | 8/2000 | D'Andrea | 206/581 |

* cited by examiner

*Primary Examiner*—Jacob K. Ackun, Jr.
(74) *Attorney, Agent, or Firm*—Oblon, Spivak, McClelland, Maier & Neustadt, P.C.

(57) ABSTRACT

A device for displaying at least one hair swatch upon a support having a noncylindrical dome shaped portion. At least one hair swatch is held securely on the device, such that it extends over the dome shaped portion and such that it is shaped by the profile of the dome shaped portion. A cover can be provided to conceal one or more locations at which the swatch or swatches are fastened to the support. The cover can have an opening through which the dome and swatch extend. A plurality of the devices can also be arranged within a display having, for example, rows and columns of the display devices.

44 Claims, 2 Drawing Sheets

HAIR SWATCH DISPLAY DEVICE, AND DISPLAY SYSTEM EQUIPPED WITH AT LEAST ONE SUCH DEVICE

CROSS REFERENCE TO RELATED APPLICATIONS

This document claims priority to French application number 0113190 filed Oct. 12, 2001, the entire content of which is hereby incorporated by reference.

BACKGROUND OF THE INVENTION

1. Field of the Invention

The present invention relates to a swatch-carrying device, such as is used to display, at a point of sale or in a hair salon, the shades of colors in a range of hair-coloring products.

2. Discussion of the Background

Traditionally, the swatches in the colors for a range of coloring products are configured in the form of loops and glued onto a support, for example a cardboard support. With such supports, the swatch is not displayed in an optimum manner because the dimensions and volume are often insufficient to show the actual color and, in particular, its glints, to fully appreciate the colors.

U.S. Pat. No. 5,647,485 describes a swatch support in which the swatch to be displayed is spread over a cylindrical curved surface. Such a swatch support can be used in conjunction with shelves of supermarkets or other distributors of hair-coloring products. However, such a device is unsuitable for arranging an entire range of colors of swatches on a single display system secured, for example, to a wall, particularly when the swatch supports are for presentation in the form of a multiple-row and column arrangement.

SUMMARY OF THE INVENTION

It is an object of the invention to provide a swatch carrying device that totally or partially solves the problems discussed above with reference to conventional display systems.

It is, in particular, an object of the invention to produce a swatch carrying device that allows the consumer to gain a more precise idea or perception of the actual color of the swatch and particularly of its glints.

It is yet a further object of the invention to provide a swatch displaying device that is economical to produce and that can be fitted, preferably removably, onto a display system that is unique as compared with conventional display systems.

Additional objects and advantages will become apparent from the following detailed description. According to the invention, the above and additional objects are achieved by a device for displaying at least one hair swatch. The device includes a support having a non-cylindrical dome shaped portion, with at least one hair swatch secured to the device and at least partly arranged over the domed portion so that the swatch is shaped to the profile of the dome.

Thus, presentation of the swatch on a dome shaped support, for example in the shape of a hemispherical cap, allows the swatch to be given more volume or exhibit the appearance of more volume and enables the swatch to catch the light better, for varying angles of incidence of the light. Therefore, appreciation of the glints or highlights of the swatch is substantially enhanced.

When such a device is fitted onto a display system secured, for example, to a wall, due to the curvature of the domed surface of the support in plural mutually non-parallel directions (in contrast to the cylindrical support as described in U.S. Pat. No. 5,647,485 referred to above), the glints and the volume of the swatch may be appreciated by a person standing face-on to the display system or standing to one side of the display system. Preferably, the curvature is constant in the plural directions to further enhance the display of the swatch.

The support can include or be formed of any synthetic or natural material, except for living tissue. It may, for example, be made from plastics, metal, wood, glass, etc. The swatches can include or be formed of natural or synthetic hair. Preferably, the length of the swatches is, for example, from approximately 7 cm to 15 cm. In addition, preferably, the swatch or swatches are each secured by their two ends in two areas located on either side of the domed portion of the support.

According to an advantageous characteristic of the invention, the device includes at least two preformed swatches arranged side-by-side on the domed portion of the support, with each swatch having a plurality of hairs pre-glued together, e.g., by heat-welding, in at least one area, and preferably in at least two areas located at each of the ends or end portions of the swatch. When the domed portion of the support has a relatively large surface area, this arrangement with at least two swatches allows or enhances the even spreading of the hairs over the domed portion.

According to a further preferred arrangement, the device includes at least three swatches, a first swatch arranged on a central area of the domed portion of the support (the highest portion), and second and third swatches arranged on either side of the first. This arrangement is advantageous in that the lateral spreading movement of each of the swatches is more limited, which maintains a density, that is both sufficient and even, of hairs all over the visible domed portion of the support, particularly when the domed portion of the support has a relatively large surface area and/or radius of curvature. This is because the swatches, positioned on both sides of the central swatch, prevent the central swatch from separating excessively on either side of the highest part of the domed surface and thereby avoid an unattractive gap in that location.

The swatch or swatches can be secured to the support, e.g., by an adhesive or glue, preferably at the two ends of the swatch or swatches.

According to a preferred embodiment, the device includes a cover fitted over the support, with the cover delimiting an opening through which emerges (or emerge) the portion(s) of swatches arranged over the domed portion of the support. With this arrangement, the opening has a cross section or size such that at least the ends of the swatch or swatches are concealed. A cover of this type maintains the even distribution of the hairs over the domed portion of the support and also gives the exposed part of the swatch or swatches a precise contour. Preferably, the cross section of the opening is substantially identical to, or even slightly larger than, the cross section of the domed portion of the support. Thus, configured relative to the domed support, the cover can stretch the swatch or swatches and force them to better match the profile of the domed portion of the support. Preferably, the periphery of the domed portion of the support and also the opening have a circular shape, with a diameter of between 5 and 10 cm and preferably between 5.5 and 9 cm. The cover can be, for example, snap-fitted onto the support.

Preferably, the domed portion of the support includes a substantially hemispherical portion or a section of a sphere. In addition, the radius of curvature of the domed portion may be close to the average radius of curvature of the cranium of an adult person. Typically, such a radius of curvature can be between 10 and 20 cm, and preferably between 12 and 18 cm.

In accordance with another advantageous optional aspect, an arrangement, for example in the form of one or more permanent magnets, can be provided for removably securing the device to a display system for receiving a plurality of such devices. The fact that the device, according to this embodiment of the invention, can be removed from the display system eases modification of the configuration of the display system, as new colors or shades need to be promoted. The securing arrangement can be secured to the back of the support, e.g., by glue or other suitable securing arrangements.

The device can also include, e.g., in the form of a tab or a notch, an arrangement for facilitating removal of the device from the display system. This feature is advantageous when the entire surface area of the display system is occupied by an arrangement of several devices arranged so close to one another that it would be difficult to remove one of them without risking damaging it or damage to the device or an adjacent device while attempting to slide a suitable tool between the surface of the display system and the back of the support.

According to a further aspect of the invention, a display system for hair swatches is provided which includes at least one first device according to the invention having one or more swatches in a first color, and at least one second device according to the invention having one or more swatches in a second color and/or shade. The first and second devices may then be set out or disposed in an arrangement with at least two rows and at least two columns.

Preferably, the display system includes a support formed at least in part from a material that is sensitive to a magnetic field, particularly a metallic sheet. Advantageously, the support is preferably flat and is bordered by a frame that projects or protrudes relative to a mid plane of the support.

BRIEF DESCRIPTION OF THE DRAWINGS

A better appreciation of the invention and many of the attendant advantages thereof will become further apparent from the following detailed description, particularly when read in conjunction with the accompanying drawings in which.

DETAILED DESCRIPTION OF THE PREFERRED EMBODIMENTS

Figure 1:
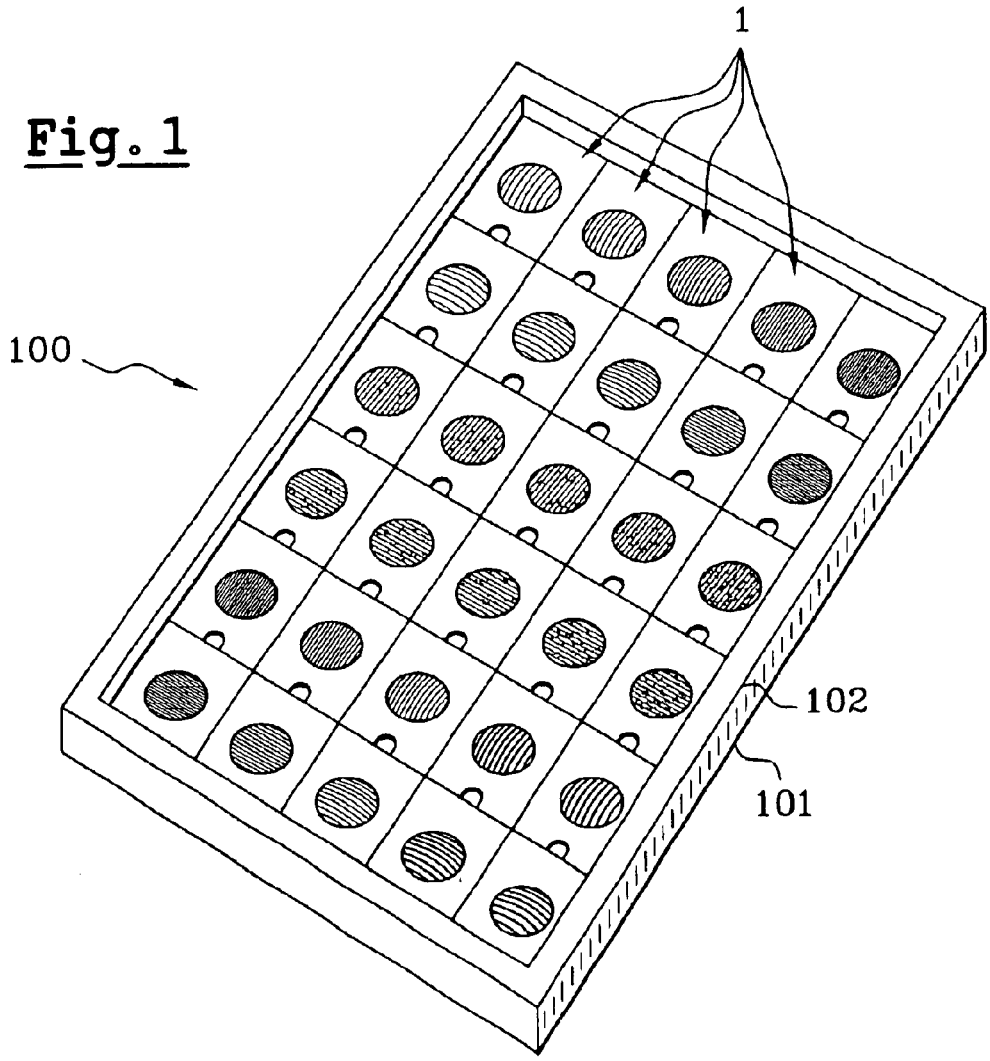
FIG. 1 is a perspective view of a swatch display system having a plurality of swatch supports according to the invention.

The display system 100 shown in FIG. 1 includes a flat support 101 having a rectangular shape, bordered by a frame 102, and on which a plurality of swatch supports 1, to be described in detail below, are arranged. As should be recognized, although the depicted support is rectangular, other shapes are also possible.

The display system 100 can be affixed to a wall or disposed upon a stand or shelf. Preferably, in the vicinity of the display system, particularly above it, adequate lighting is provided (not shown) that is capable of generating glints or making highlights more visible on the swatches carried by each of the swatch supports 1.

According to an additional preferred aspect, the flat support 101 includes at least one metallic sheet so that the swatch supports 1 can be removably magnetically affixed to the display system 100.

Figure 3:
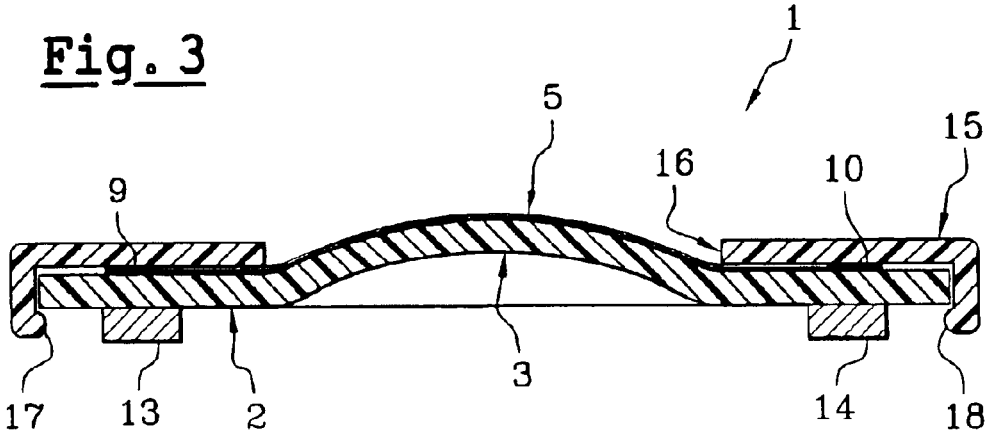
FIG. 3 is a sectional view of the swatch support in FIG. 2.
Figure 2:
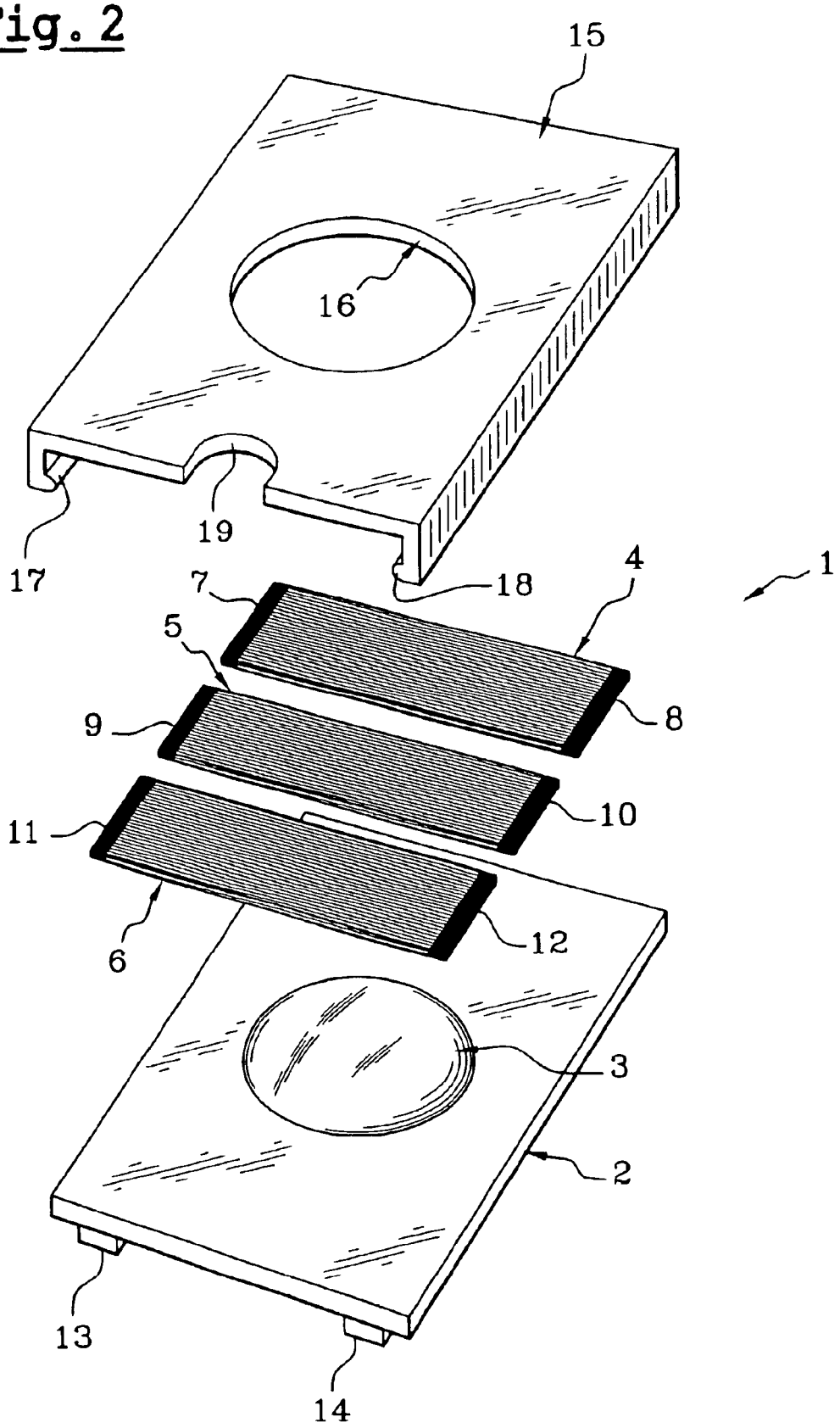
FIG. 2 is an exploded view of a swatch support according to a preferred embodiment of the invention.

The swatch supports 1 are preferably arranged in the form of a plurality of rows, with each corresponding to a given color, and a plurality of columns, each corresponding to a shade or to a degree of said colors. The swatch support 1 shown in FIGS. 2 and 3 includes a support 2 in the form of a rectangular plate, at the center of which a cap 3 is formed with a shape corresponding to a section of a sphere. The cap 3 can be hemispherical. However, the cap can also be a smaller or different section of a sphere, e.g., resembling a calotte, as should be apparent from FIGS. 2 and 3. The radius of curvature of the cap 3 is of the order of 15 cm. The radius of the domed portion 3 of the support is of the order of 8 to 9 cm. It is also possible to have a dome shaped cap or three-dimensionally curved portions that are sections of shapes that are not exactly spherical, e.g., with the dome formed as a section of an egg-shape or other shape. Preferably, the dome is non-cylindrical, however.

The plate 2 can be produced, for example, from various suitable materials such as Perspex.

According to one of the preferred embodiments, three swatches 4, 5, 6 in flat form and in an identical color are arranged side-by-side over the domed portion 3 of the support 2. The swatches 4, 5, 6 are formed from a plurality of strands glued together in two heat-welded areas 7–12 arranged at the two ends of each swatch. The width of each swatch 4, 5, 6 is approximately 25 mm, by way of example.

On the side of the support 2 that is opposite the dome 3, the support 2 includes, for example, two magnetized strips 13, 14 for securing the swatch support 1 to the display system 100 described with reference to FIG. 1. The swatches 4, 5, 6 are glued to the support 2 via their heat welded areas 7–12 on either side of the dome 3, so that the hairs forming the swatches 4, 5, 6 evenly and relatively densely cover the entire surface area of the domed portion 3 of the support 2.

After attaching the swatches 4, 5, 6 such that they extend over the domed portion 3 of the support 2, a cover 15 (preferably of the same shape as the support 2) having a circular window 16 with a diameter slightly greater than the diameter of the dome 3 is arranged over the support 2. The cover 15 is preferably formed of a non-transparent thermoplastic material. On two opposite sides, the cover 15 preferably has a rim 17, 18 ending in a beading for snap-fitting the cover 15 over the support 2. On one of the edges of the cover 15 that are perpendicular to the rims 17 and 18, the cover can have a notch 19 for easing removal of the swatch support 1 from the display system 100.

In order to fit the cover 15 over the support 2, after having evenly spread out the strands that form the three swatches 4, 5, 6 over the entire domed surface area of the support 2, the window 16 is placed opposite the domed portion 3 of the support 2. The rims 17 and 18 are then snap-fitted over the corresponding edges of the support 2. With this arrangement, the swatches are held firmly in their even-spread configuration over the entire visible domed surface area 3 of the support 2. The glued portions 7–12 of the swatches 4–6 are thus concealed behind the circular edge of the cover delimiting the opening 16.

On the front face of the cover 15, it is possible to provide a logo, an acronym or any other commercial identification.

On the back of the plate 2 of each swatch support 1 there can be a designation of the relevant hair color.

Obviously, numerous modifications and variations of the present invention are possible in light of the above teachings. It is therefore to be understood that, within the scope of the appended claims, the invention may be practiced otherwise than as specifically described herein.

What is claimed is:

1. A device for displaying at least one hair swatch comprising:

a support having a non-cylindrical dome shaped portion; and at least one hair swatch held securely on the device, said at least one hair swatch being, at least in part, arranged over the domed portion such that said at least one hair swatch is shaped by the profile of the dome shaped portion.

2. A device as recited in claim 1, wherein two ends of the at least one swatch are secured to two areas of the support located on either side of the dome shaped portion of the support.

3. A device as recited in claim 1, wherein at least two swatches are arranged side-by-side on the dome shaped portion of the support, and wherein each swatch includes a plurality of hairs pre-glued together in at least one area.

4. A device as recited in claim 3, wherein said at least one area is secured to said support at a location other than on said dome shaped portion.

5. A device as recited in claim 1, wherein the at least one swatch includes a plurality of hairs which are coupled together at first and second locations, and wherein said first and second locations are secured to the support on either side of the dome shaped portion.

6. A device as recited in claim 1, which comprises at least three swatches including a first swatch arranged on a central area of the domed portion of the support, and second and third swatches arranged on either side of the first swatch.

7. A device as recited in claim 6, wherein the swatches are each secured and glued to the support at two ends of each of said swatches.

8. A device as recited in claim 1, further comprising:

a cover fitted over the support, said cover having an opening through which emerges at least a portion of the at least one swatch which is arranged over the dome shaped portion of the support.

9. A device as recited in claim 8, wherein said cover masks end portions of the at least one swatch.

10. A device as recited in claim 9, wherein the end portions of the at least one swatch are secured to said support at locations other than on the dome shaped potion.

11. A device as recited in claim 10, wherein the at least one swatch includes a plurality of hairs that are glued together at said end portions.

12. A device as recited in claim 11, wherein a plurality of said swatches extend over said dome portion.

13. A device as recited in claim 3, wherein at least first, second and third of said swatches are provided, and wherein said first swatch extends over an apex of said dome, and further wherein said first swatch is positioned between said second and third swatches.

14. A device as recited in claim 8, wherein the opening has a size which is substantially the same as a size of a periphery of the dome shaped portion of the support.

15. A device as recited in claim 8, wherein the dome shaped portion of the support has a circular periphery and said opening has a circular shape, with each having a diameter between 5 and 10 cm.

16. A device as recited in claim 15, wherein the periphery of the dome shaped portion and the opening each have a diameter between 5.5 and 9 cm.

17. A device as recited in claim 8, wherein the cover is snap-fitted onto the support.

18. A device as recited in claim 1, wherein the dome shaped portion of the support has a shape of a segment of a sphere.

19. A device as recited in claim 1, wherein the dome shaped portion of the support has a radius of curvature close to the average radius of curvature of the cranium of an adult person.

20. A device as recited in claim 19, wherein the radius of curvature is between 10 and 20 cm.

21. A device as recited in claim 20, wherein said radius of curvature is between 12 and 18 cm.

22. A device as recited in claim 1, which further comprises at least one permanent magnet for removably securing the device to a display system which receives a plurality of such devices.

23. A device as recited in claim 1, wherein securing means are secured to the back of the support for removably securing the device to a display system which receives a plurality of such devices.

24. A device as recited in claim 23, wherein said securing means are glued to the back of said support.

25. A device as recited in claim 23, further including means, for facilitating removal of the device from said display system.

26. A device as recited in claim 25, wherein said means for facilitating removal includes a notch.

27. A device as recited in claim 25, wherein said means for facilitating removal includes a tab.

28. A display system for hair swatches, comprising a plurality of display devices, each display device comprising:

a support having a non-cylindrical dome shaped portion; and at least one hair swatch held securely on the device, said at least one hair swatch being, at least in part, arranged over the domed portion such that said at least one hair swatch is shaped by the profile of the dome shaped portion;

wherein said plurality of display devices includes at least one first display device including at least one swatch having a first color, and at least one second display device including at least one swatch having a second color.

29. A display system as recited in claim 28, wherein said second color is different than said first color.

30. A display system as recited in claim 28, wherein said second color is of a different shade than said first color.

31. A display system as recited in claim 28, further including a system support that includes a material that is one of a magnetic material and a material that is attracted by a magnet.

32. A display system as recited in claim 15, further including a system support that is at least substantially flat and that is bordered by a frame.

33. A display system as recited in claim 15, wherein the plurality of display devices are arranged in at least two rows and at least two columns.

34. An assembly for displaying at least one hair swatch comprising:

a support having a dome shaped portion and wherein said dome shaped portion is non-cylindrical, at least one hair swatch disposed on said support and extending over said dome shaped portion; and a cover having an aperture through which extends at least a portion of said dome shaped portion and a portion of said at least one swatch.

35. An assembly as recited in claim 34, including a plurality of said supports, with each having one of said covers and at least one swatch associated therewith.

36. An assembly as recited in claim 35, wherein said assembly includes an assembly support and wherein said supports having said dome shaped portions are disposed on said assembly support.

37. An assembly as recited in claim 36, wherein said supports having said dome shaped portions are coupled magnetically to said assembly support.

38. An assembly as recited in claim 34, wherein plural rows and plural columns of supports are provided, and wherein traversing a row of supports, swatches having one of a different color and a different shade are provided, and further wherein, traversing a column, swatches having the other of a different color and a different shade are provided.

39. An assembly as recited in claim 35, wherein notches are associated with at least one of said covers and said supports to ease removal from said assembly.

40. An assembly as recited in claim 34, wherein said dome shaped portion is a section of a sphere.

41. An assembly as recited in claim 34, wherein said at least one swatch includes a swatch extending over an apex of said dome shaped portion.

42. An assembly as recited in claim 34, wherein three swatches extend over said dome shaped portion, and wherein one of said swatches extends over an apex of said dome shaped portion and is positioned between the other two swatches.

43. An assembly as recited in claim 34, wherein said at least one swatch includes a plurality of hairs that are coupled together at first and second end portions.

44. An assembly as recited in claim 43, wherein said first and second end portions are secured to said support at a location disposed underneath said cover and wherein said cover conceals said first and second end portions.

* * * * *